US011833482B2

(12) United States Patent
Takemoto et al.

(10) Patent No.: US 11,833,482 B2
(45) Date of Patent: Dec. 5, 2023

(54) METHOD FOR PRODUCING PARTICLE MIXTURE

(71) Applicant: SUMITOMO SEIKA CHEMICALS CO., LTD., Hyogo (JP)

(72) Inventors: Kazushi Takemoto, Himeji (JP); Kenji Nakamura, Himeji (JP); Hideo Kazama, Himeji (JP)

(73) Assignee: SUMITOMO SEIKA CHEMICALS CO., LTD., Hyogo (JP)

( * ) Notice: Subject to any disclaimer, the term of this patent is extended or adjusted under 35 U.S.C. 154(b) by 610 days.

(21) Appl. No.: 16/496,361

(22) PCT Filed: Jan. 25, 2018

(86) PCT No.: PCT/JP2018/002270
§ 371 (c)(1),
(2) Date: Sep. 20, 2019

(87) PCT Pub. No.: WO2018/173471
PCT Pub. Date: Sep. 27, 2018

(65) Prior Publication Data

US 2020/0139315 A1 May 7, 2020

(30) Foreign Application Priority Data

Mar. 23, 2017 (JP) ..... 2017-057685

(51) Int. Cl.
*B01F 25/82* (2022.01)
*B01F 23/60* (2022.01)
(Continued)

(52) U.S. Cl.
CPC ..... *B01F 25/823* (2022.01); *B01F 23/69* (2022.01); *B01F 27/72* (2022.01); *B01F 27/75* (2022.01);
(Continued)

(58) Field of Classification Search
CPC ..... B01F 25/823; B01F 23/69; B01F 27/72; B01F 27/75; B01F 33/8212;
(Continued)

(56) References Cited

U.S. PATENT DOCUMENTS 5,282,548 A * 2/1994 Ishihara ..... B29B 7/801 222/64
9,878,304 B2 * 1/2018 Kotake ..... C08L 33/06
(Continued)

FOREIGN PATENT DOCUMENTS

CN 1404414 A 3/2003
CN 101790414 A 7/2010
(Continued)

OTHER PUBLICATIONS

Japanese Office Action in Japanese Patent Application No. 2019-507394, dated Aug. 31, 2021.
(Continued)

*Primary Examiner* — Charles Cooley
(74) *Attorney, Agent, or Firm* — Knobbe Martens Olson & Bear LLP

(57) ABSTRACT

A production method for producing a particle mixture in which two or more types of particles are mixed, including a step of adding a first additive to first particles and mixing the first additive with the first particles using a first mixer and a step of introducing the two or more types of particles including the first particles mixed with the first additive and second particles into a blender container of a gravity blender, and mixing the two or more types of particles inside the blender container.

7 Claims, 2 Drawing Sheets

(51) Int. Cl.

| | |
|---|---|
| ***B01F 27/72*** | (2022.01) |
| ***B01F 27/75*** | (2022.01) |
| ***B01F 33/82*** | (2022.01) |
| ***B01F 25/00*** | (2022.01) |
| ***B01F 101/00*** | (2022.01) |

(52) U.S. Cl.
CPC ..... *B01F 33/8212* (2022.01); *B01F 2025/911* (2022.01); *B01F 2101/2204* (2022.01)

(58) Field of Classification Search
CPC ..... B01F 2025/911; B01F 2101/2204; B01F 25/821; B01F 33/805; B01F 25/50; B01F 23/60; B01F 25/80; B29B 7/42; B29B 7/421; B29B 7/845; B29B 7/823; B29B 7/7485; B29B 7/7461; B29B 7/429; B29B 7/482; B29B 7/422; B29B 7/726; B29B 7/603; B29B 7/404; B29B 7/487; B29B 7/488; B29B 7/72; B29B 7/802; B29B 7/88; B29B 9/06; B29B 9/12; B29B 7/483; B29B 7/728; B29C 48/82; B29C 48/802; B29C 48/625; B29C 48/385; B29C 48/535; B29C 48/55; B29C 48/54; B29C 48/72; B29C 48/402; B29C 48/2526; B29C 48/2692; B29C 48/271; B29C 48/2715; B29C 48/297; B29C 48/39; B29C 2948/92095; B29C 2948/9239; B29C 2948/92457; B29C 2948/926; B29C 2948/92828; B29K 2105/0032
See application file for complete search history.

(56) References Cited

U.S. PATENT DOCUMENTS

| | | | | |
|---|---|---|---|---|
| 2002/0136089 | A1 | 9/2002 | Folestad et al. | |
| 2004/0008570 | A1 | 1/2004 | Folestad et al. | |
| 2007/0225160 | A1* | 9/2007 | Kitano | A61L 15/60 502/402 |
| 2008/0170462 | A1 | 7/2008 | Ueda | |
| 2011/0211418 | A1 | 9/2011 | Tassone et al. | |
| 2014/0080045 | A1* | 3/2014 | Suzuki | G03G 9/08 430/105 |
| 2016/0051966 | A1* | 2/2016 | Kotake | C08L 33/06 252/194 |

FOREIGN PATENT DOCUMENTS

| | | | | |
|---|---|---|---|---|
| CN | 105164186 | A | 12/2015 | |
| EP | 0249826 | A2 | 12/1987 | |
| EP | 2 980 128 | A1 | 2/2016 | |
| JP | S54-030571 | A | 3/1979 | |
| JP | S61-25929 | U | 2/1986 | |
| JP | H11-246625 | A | 9/1999 | |
| JP | 2002-263132 | A | 9/2002 | |
| JP | 2004-195336 | A | 7/2004 | |
| JP | 2010-138278 | A | 6/2010 | |
| JP | 2014-074881 | A | 4/2014 | |
| KR | 10-2015-0135325 | B1 | 12/2015 | |
| KR | 10-2016-0051726 | B1 | 5/2016 | |
| TW | 201436825 | A | 10/2014 | |
| WO | WO 2010/114381 | A1 | 10/2010 | |
| WO | WO 2014/156289 | A1 | 10/2014 | |
| WO | WO 2014/207510 | A1 | 12/2014 | |
| WO | WO-2018173471 | A1 * | 9/2018 | B01F 13/1002 |

OTHER PUBLICATIONS

Japanese Notice of Reasons for Refusal in Japanese Patent Application No. 2019-507394 dated Mar. 1, 2022.
Written Opinion in Singapore Patent Application No. 11201908644X dated Jul. 9, 2021.
Supplementary European Search Report, EP Patent Application No. 18770193.3, dated Dec. 16, 2020.
Chinese Office Action, Chinese Patent Application No. 201880016836.7, dated Jul. 13, 2021.
Search Report and Written Opinion, in corresponding Singapore Patent Application No. 11201908644X, dated Jul. 27, 2020.
Taiwanese Office Action in TW Patent Application No. 107103235 dated Sep. 8, 2021.
International Search Report in International Application No. PCT/JP2018/002270, dated Apr. 3, 2018.
Korean Office Action issued in Korean Patent Application No. 10-2019-7026887 dated Jul. 7, 2022.
Chinese Office Action issued in Chinese Patent Application No. 201880016836.7 dated Mar. 24, 2022.
Examination Report in Counterpart Singaporean Patent Application No. 11201908644X, dated Sep. 5, 2022.
Office Action in Counterpart Indonesian Patent Application No. P00201908562 dated Feb. 3, 2023.

* cited by examiner

METHOD FOR PRODUCING PARTICLE MIXTURE

TECHNICAL FIELD

The present invention relates to a production method and an apparatus for producing a particle mixture in which two or more types of particles are mixed.

BACKGROUND ART

Water-absorbent resin particles are used as a material to be used in hygienic articles such as disposable diapers, an industrial material, a water retention agent for agriculture and horticulture, and the like in various applications. Although the water-absorbent resin particles may be used alone, the water-absorbent resin particles are often used after an additive is added thereto. For example, Patent Literature 1 discloses that silica particles are mixed, as an additive, with water-absorbent resin particles for the purpose of improving properties such as water absorbing properties and fluidity.

CITATION LIST

Patent Literature

Patent Literature 1: JP 2008-315657A

SUMMARY OF INVENTION

Technical Problem

Patent Literature 1 states that the water-absorbent resin particles and the silica particles are mixed together using a mechanical-stirring type blending machine such as a ribbon blender or a Loedige mixer. However, this method is not always suitable when two or more types of water-absorbent resin particles are mixed with an additive. This particularly holds true for producing a large amount of particle mixture containing two or more types of water-absorbent resin particles and an additive. This issue also holds true for mixing another type of particles other than water-absorbent resin particles with an additive.

It is an object of the present invention to easily produce a large amount of particle mixture in which two or more types of particles are mixed with an additive.

Solution to Problem

A production method according to a first aspect is a production method for producing a particle mixture in which two or more types of particles are mixed, and includes the following steps (1) and (2):

(1) a step of adding a first additive to first particles and mixing the first additive with the first particles using a first mixer; and (2) a step of introducing the two or more types of particles including the first particles mixed with the first additive and second particles into a blender container of a gravity blender, and mixing the two or more types of particles inside the blender container.

A production method according to a second aspect is the production method according to the first aspect, and further includes the following step (3):

(3) a step of adding a second additive to the second particles and mixing the second additive with the second particles using a second mixer.

With the production method according to the second aspect, the step (2) above includes introducing the two or more types of particles including the first particles mixed with the first additive and the second particles mixed with the second additive into the blender container and mixing the two or more types of particles inside the blender container.

A production method according to a third aspect is the production method according to the first aspect or the second aspect, wherein the first particles and the second particles are made of the same material and have different average particle diameters.

A production method according to a fourth aspect is the production method according to the first aspect or the second aspect, wherein the first particles and the second particles are of the same type. With the production method according to the fourth aspect, the step (2) above includes introducing the two or more types of particles including the first particles mixed with the first additive and the second particles mixed with no first additive into the blender container and mixing the two or more types of particles inside the blender container.

A production method according to a fifth aspect is the production method according to any one of the first aspect to the fourth aspect, wherein the blender container is provided with an inlet in an upper portion and an outlet in a lower portion. With the production method according to the fifth aspect, the step (2) above includes a step of mixing the two or more types of particles while allowing the two or more types of particles to fall from the inlet to the outlet with the force of gravity, and then conveying the two or more types of particles from the outlet to the inlet in order to mix the two or more types of particles again while allowing the two or more particles to fall from the inlet to the outlet with the force of gravity.

A production method according to a sixth aspect is the production method according to any one of the first aspect to the fifth aspect, wherein the first particles and the second particles are water-absorbent resin particles.

A production method according to a seventh aspect is the production method according to any one of the first aspect to the sixth aspect, wherein the step (2) above includes a step of introducing the first particles mixed with the first additive and the second particles into the blender container alternately and repeatedly.

A production apparatus according to an eighth aspect is a production apparatus for producing a particle mixture in which two or more types of particles are mixed, and includes a first mixer that includes a first container for accommodating first particles and mixes the first particles and a first additive together inside the first container, a second container for accommodating second particles, and a gravity blender. The gravity blender includes a blender container provided with an inlet in an upper portion, the inlet being connected to the first container and the second container. The gravity blender receives the two or more types of particles including the first particles mixed with the first additive conveyed from the first container and the second particles conveyed from the second container in the blender container through the inlet, and mixes the two or more types of particles inside the blender container.

Advantageous Effects of the Invention

With the present invention, the first additive is added to the first particles and mixed using the first mixer. Furthermore, two or more types of particles including the second particles and the first particles mixed with the first additive are mixed using the gravity blender. That is, the first particles, the first additive, and the second particles are not mixed together at once, but are mixed in a stepwise manner using the first mixer and the gravity blender, thus making it easy to produce a large amount of particle mixture in which two or more types of particles are mixed with an additive.

DESCRIPTION OF EMBODIMENTS

Hereinafter, a production method and an apparatus for producing a particle mixture according to an embodiment of the present invention will be described with reference to the drawings.

1. Production System

Figure 1:
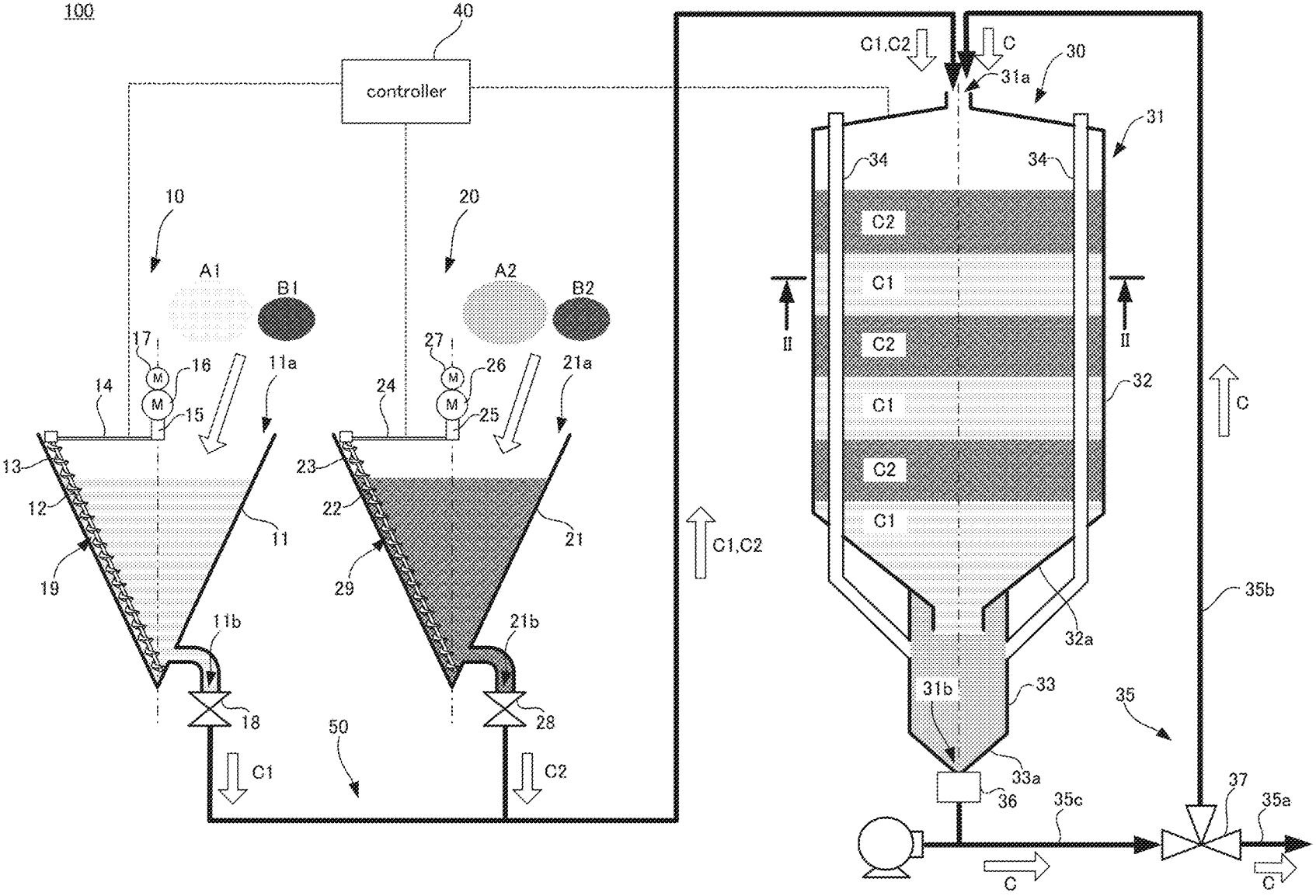
FIG. 1 is a diagram illustrating the overall configuration of a production line system that is a production apparatus for producing a particle mixture according to an embodiment of the present invention.

FIG. 1 is a diagram illustrating the overall configuration of a production line system 100 that is a production apparatus for producing a particle mixture according to an embodiment of the present invention. The production line system 100 is a system for mixing two or more types of particles with an additive, and includes a first mixer 10, a second mixer 20, and a blender 30 connected downstream of these mixers 10 and 20 as shown in FIG. 1. It should be noted that FIG. 1 shows longitudinal cross-sectional views of the first mixer 10, the second mixer 20, and the blender 30. In the following description, the up-down (vertical) direction and the horizontal direction are defined based on the state shown in FIG. 1 unless otherwise stated.

In this embodiment, the first mixer 10 and the second mixer 20 are driven-type blending machines in which stirring force is generated by driving mixing blades 19 and 29. More specifically, Nauta mixers are used as these mixers. The blender 30 is a gravity blender. In this embodiment, a silo blender is used as the blender 30.

The first mixer 10 includes a container 11 for accommodating particles to be mixed in addition to the mixing blade 19. The container 11 has a substantially inverted conical shape, and is provided with an opening 11*a* serving as a particle inlet in the upper portion thereof and an opening 11*b* serving as a particle outlet in the lower portion thereof. The mixing blade 19 includes an elongated shaft 12 and a screw blade 13 that spirally winds around the shaft 12. The mixing blade 19 is arranged extending in a direction inclined with respect to the up-down direction to extend substantially in parallel with the inner wall surface of the container 11 inside the container 11. A swing arm 14 that substantially horizontally extends from the upper portion of the shaft 12 to the vicinity of the central axis of the container 11 is coupled to the upper portion of the shaft 12. The central axis of the container 11 extends substantially in the up-down direction. Furthermore, a shaft 15 extending substantially along the central axis of the container 11 in the up-down direction is coupled to the end portion on the interior side of the swing arm 14. The shaft 15 is rotated by a driving mechanism 16 such as a motor. Thus, the mixing blade 19 moves around the central axis of the container 11 so as to move on an inverted conical trajectory along the inner wall surface of the container 11. A driving mechanism 17 such as a motor for driving the shaft 12 is provided adjacent to the driving mechanism 16, and power is conveyed from the driving mechanism 17 via the shaft 15 and the swing arm 14 to the shaft 12. As a result, in the container 11, the mixing blade 19 revolves around the shaft 15, namely the central axis of the container 11, while rotating around the shaft 12.

Particles A1 to be mixed using the first mixer 10 and an additive B1 to be added thereto are loaded into the container 11 through the upper opening 11*a* and mixed by the movement of the blade 19 in the container 11. That is, the particles A1 and B1 are moved up by the rotation of the mixing blade 19, and the entirety thereof is greatly stirred by the revolution. The additive B1 is thus mixed uniformly with the particles A1, and a particle mixture C1 is thus produced.

In this embodiment, the second mixer 20 has the same configuration and functions as those of the first embodiment, and includes components 21 to 29, 21*a*, and 21*b* that respectively correspond to the components 11 to 19, 11*a*, and 11*b*. With the second mixer 20, the additive B1 is mixed uniformly with particles A2, and a particle mixture C2 is thus produced.

Although there is no particular limitation on the types of particles A1 and A2 and additives B1 and B2, both types of particles A1 and A2 are water-absorbent resin particles (pellets) in this embodiment. In this case, silica particles can be selected as the additives B1 and B2 in order to improve the properties such as water absorbing properties and fluidity of the particles A1 and A2, for example. The particles A1 and A2 can be particles of the same type or different types. Also, the additives B1 and B2 can be particles of the same type or different types.

Here, "the particles A1 and particles A2 are of the same type" means that the particles A1 and A2 are made of the same material and have substantially the same average particle diameter. It should be noted that "the particles A1 and A2 have substantially the same average particle diameter" means that the average particle diameter of the particles A2 is within a range of 95 to 105% of the average particle diameter of the particles A1. The same applies to the additives B1 and B2.

Moreover, "the particles A1 and the particles A2 are of different types" means that at least one of the materials and the average particle diameter of the particles A1 is different from those of the particles A2. Therefore, "the particles A1 and the particles A2 are of different types" can mean a case where the particles A1 and the particles A2 are made of the same material, but have different average particle diameters. It should be noted that "the particles A1 and the particles A2 have different average particle diameters" means that the average particle diameter of the particles A2 is smaller than 95% or greater than 105% of the average particle diameter of the particles A1. The same applies to the additives B1 and B2.

Although there is no particular limitation on the average particle diameters of the particles A1 and A2 and the additives B1 and B2, water-absorbent resin particles typically have an average particle diameter of 100 μm to 1 mm, and more typically 200 μm to 600 μm. On the other hand, silica particles to be added to the water-absorbent resin particles typically have an average particle diameter of 1 μm to 30 μm, and more typically 2 μm to 20 μm.

The particle mixtures C1 and C2 are respectively discharged from the containers 11 and 21 through the openings 11*b* and 21*b*, and are conveyed to the blender 30. It should be noted that the openings 11*b* and 21*b* are respectively opened and closed by opening/closing mechanisms 18 and 28, and are opened in order to discharge the particle mixtures C1 and C2 after mixing steps in the mixers 10 and 20 finish. The opening/closing mechanisms 18 and 28 can be configured as appropriate, and electronically controlled valves are used in these mechanisms, for example.

The blender 30 includes a silo 31 serving as a container for accommodating particles to be mixed. The blender 30 is a gravity blender that utilizes gravity to mix particles and thus includes no mixing blade or the like. The silo 31 has a tubular shape, and is provided with an opening 31*a* serving as a particle inlet in the upper portion thereof and an opening 31*b* serving as a particle outlet in the lower portion thereof. A conveyance route 50 is provided between the opening 31*a* and the openings 11*b* and 12*b*, which respectively serve as the outlets of the mixers 10 and 20, and connects them. The particle mixtures C1 and C2 are conveyed from the openings 11*b* and 21*b* via the conveyance route 50 to the opening 31*a*, and are loaded into the silo 31 through the opening 31*a*. It should be noted that, although there is no particular limitation on the configuration of the conveyance route 50, the conveyance route 50 can be constituted by a duct through which the particles pass and a blower that sends air to move the particles along the duct, or by a bucket conveyor, a movable hopper, and the like, or by a combination of these conveyance mechanisms.

There is no particular limitation on the volume of the silo 31, and there is also no particular limitation on the volumes of the container 11 of the first mixer 10 and the container 21 of the second mixer 20. However, since the silo 31 is of a gravity type and thus there is no need to drive a mixing blade unlike the cases of the first mixer 10 and the second mixer 20 of this embodiment, the volume of the silo 31 can be increased more easily than those of the container 11 of the first mixer 10 and the container 21 of the second mixer 20. Increasing the volume of the silo 31 makes it possible to mix a large amount of particles at once. A ratio R (=V2/V1) of a volume V2 of the silo 31 to a volume V1 of the container 11 of the first mixer 10 or the container 21 of the second mixer 20 is preferably 2 or greater, more preferably 5 or greater, and even more preferably 10 or greater.

The silo 31 includes a container body 32 and a blend chamber 33 that is located below the container body 32 and that has a smaller diameter and a smaller volume than the container body 32. The central axis of the silo 31 extends substantially in the up-down direction, and the container body 32 and the blend chamber 33 are coaxially arranged. The opening 31*a* is formed in the upper portion of the container body 32. The container body 32 has a substantially tubular shape as a whole, but a lower portion 32*a* thereof has a funnel shape (substantially inverted conical shape), and is introduced into the blend chamber through the upper opening of the blend chamber 33. The blend chamber 33 also has a substantially tubular shape, but a lower portion 33*a* thereof is formed into a funnel shape (substantially inverted conical shape). The opening 31*b* is formed in the lower portion 33*a* of the blend chamber 33 and corresponds to an outlet of a funnel. As described above, the space inside the container body 32 and the space inside the blend chamber 33 are in communication with each other.

Figure 2:
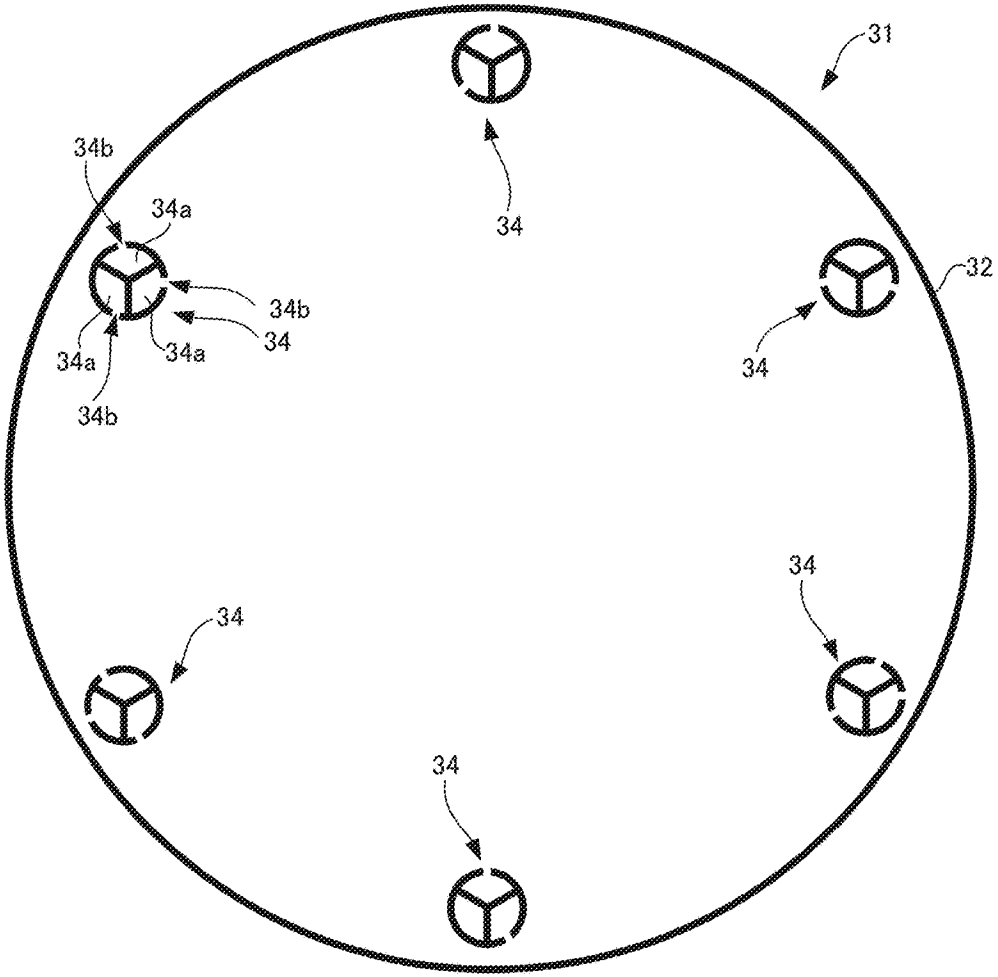
FIG. 2 is a cross-sectional view taken along line II-II in FIG. 1.

FIG. 2 is a lateral cross-sectional view of the blender 30 taken at a height indicated by line II-II in FIG. 1. As shown in FIG. 2, a plurality of (six in this embodiment) blend pipes 34 are arranged around the central axis of the silo 31 at regular intervals inside the container body 32. These blend pipes 34 are arranged near the inner wall surface of the container body 32, extend substantially in the up-down direction, pass through the inclined wall of the funnel-shaped lower portion 32*a* of the container body 32, and protrude outward from the silo 31. Then, the blend pipes 34 are bent toward the inside in the radial direction while extending downward, pass through the side wall of the blend chamber 33, and are in communication with the blend chamber 33.

The inner space of each blend pipe 34 is partitioned into a plurality of chambers 34*a* that are adjacent to each other in the circumferential direction of the blend pipe 34 and extend substantially in the axial direction of the blend pipe 34, that is, substantially in the up-down direction. A large number of holes 34*b* are formed in the side wall of each blend pipe 34. These holes 34*b* are spaced out substantially evenly in the entire side wall of the blend pipe 34. The particle mixtures C1 and C2 loaded into the silo 31 through the upper opening 31*a* move into the blend chamber 33 while falling through the container body 32 with the force of gravity. In this process, portions of the particle mixtures C1 and C2 enter the blend pipes 34 through the holes 34*b* and move into the blend chamber 33 while falling through the blend pipes 34 with the force of gravity. At this time, the speed of the particle mixtures C1 and C2 moving inside the container body 32 is different from the speed of the particle mixtures C1 and C2 moving inside the blend pipes 34, and therefore, the particle mixtures C1 and C2 are mixed when joining together inside the blend chamber 33. A particle mixture C in which the particle mixture C1 conveyed from the first mixer 10 and the particle mixture C2 conveyed from the second mixer 20 are mixed is thus produced. In the particle mixture C, the particles A1 and A2 and the additives B1 and B2 are mixed uniformly.

The lower opening 31*b* of the blend chamber 33 is connected to a conveyance route 35, and the particle mixture C is discharged into the conveyance route 35 through the opening 31*b*. A conveyance mechanism 36 controls the amount of particle mixture C discharged to the downstream side through the opening 31*b*. The conveyance mechanism 36 is driven to convey the particle mixture C to the conveyance route 35.

The conveyance mechanism 36 can be configured as appropriate, and an electronically controlled rotary valve is used in this mechanism, for example.

The conveyance route 35 is constituted by a conveyance route 35*c* arranged immediately downstream of the opening 31*b*, and a conveyance route 35*a* and a conveyance route 35*b* that are connected to a downstream portion of the conveyance route 35*c* and branch off from the conveyance route 35*c*. The conveyance route 35*a* is used to convey the particle mixture C toward the downstream side of the blender 30. The conveyance route 35*a* is connected to a packaging machine (not shown) for packaging the particle mixture C, for example. Meanwhile, the conveyance route 35*b* extends to the upper opening 31*a* of the container body 32, and is used to convey, to the opening 31*a* again, the particle mixture C discharged from the silo 31. That is, the blender 30 serves as a circulating-type blender due to the conveyance route 35*b*. With this configuration, the particle mixture C additionally passes through the silo 31 from the opening 31*a* to the opening 31*b*, thus making it possible to more uniformly mix the particles A1, the particles A2, the additive B1, and the additive B2 together. The particle mixture C, which is finally produced after the particle mixtures C1 and C2 are circulated in the silo 31 and the conveyance routes 35*b* and 35*c*, is conveyed through the conveyance route 35*a* toward the farther downstream side.

It should be noted that, although there is no particular limitation on the configuration of the conveyance route 35, the conveyance route 35 can be constituted by a duct through which the particles pass and a blower that sends air to move the particles along the duct, or by a bucket conveyor, a movable hopper, and the like, or by a combination of these conveyance mechanisms.

The number N of circulation time of particles C1 and C2 in the silo 31 and the conveyance routes 35*b* and 35*c* is defined by an equation "N=N2·t/N1". In this equation, N1 is the total amount (kg) of the particles C1 and C2 to be mixed together, N2 is the flow rate (kg/h) of the particles that have passed through the conveyance route 35*b*, and t is the circulation period (h). "The number N of circulation time=0" means that the particles C1 and C2 do not return to the silo 31 through the conveyance route 35*b* after once passing through the silo 31. Moreover, the number N of circulation time is not necessarily an integer and can be any number that satisfies a relationship N≥0, such as 1.5. However, N is preferably 1.5 or greater, more preferably greater than 1.5 and smaller than 2.5, and even more preferably equal to about 2. The greater the number N of circulation time is, more uniformly the particles C1 and C2 are mixed together, but there is a tendency for the mixing uniformity to reach the upper limit when N is equal to about 2. Therefore, when N is within the above-mentioned value range, the particles C1 and C2 can be efficiently mixed together in a shorter period of time.

The conveyance direction, that is, a direction toward the conveyance route 35*a* or the conveyance route 35*b*, in which the particle mixture C discharged from the silo 31 to the conveyance route 35*c* is to move in can be changed using a switching mechanism 37. The switching mechanism 37 can be configured as appropriate, and an electronically controlled three-way switching valve can be arranged at a position where the conveyance routes 35*a* to 35*c* are coupled, and used as the switching mechanism 37, for example.

The driving components included in the production line system 100, such as the above-described driving components 16, 17, 18, 26, 27, 28, 35, 36, 37, and 50, are connected to a controller 40, and the controller 40 controls the operations of these driving components. The controller 40 includes a CPU, a ROM, a RAM, a nonvolatile storage device, and the like, and reads out and executes a program stored in the ROM or nonvolatile storage device to cause the driving components to operate as described above and later. It should be noted that the controller 40 may include controllers that control the mixers 10 and 20 and the blender 30, and/or a controller that collectively controls these devices 10 to 30. When a plurality of controllers are present, a configuration may also be adopted in which these controllers are connected to one another to communicate with one another and operate cooperatively.

2. Production Method

Next, a method for producing the particle mixture C using the production line system 100 will be described.

First, the particles A1 and the additive B1 are mixed together in the first mixer 10 (first mixing step). Specifically, the opening/closing mechanism 18 is controlled to close the opening lib of the container 11, and while this state is maintained, predetermined amounts of particles A1 and additive B1 are introduced into the container 11 through the opening 11*a*. The particles A1 and the additive B1 can be introduced by an operator manually loading the particles A1 and the additive B1 into the container 11 or using a hopper or the like provided on the upstream side. Subsequently, while the opening 11*b* remains closed, the mixing blade 19 is caused to rotate and revolve by driving the driving mechanisms 16 and 17 for a predetermined period of time, and thus the particles A1 and the additive B1 are stirred inside the container 11. Accordingly, the particles A1 and the additive B1 are mixed together, and the particle mixture C1 in which the additive B1 is uniformly dispersed in the particles A1 is thus produced.

Simultaneously with, or before or after, the first mixing step performed in the first mixer 10, the particles 42 and the additive 132 are mixed together in the second mixer 20 (second mixing step). Accordingly, the particles 42 and the additive B2 are mixed together, and the particle mixture C1 in which the additive B2 is uniformly dispersed in the particles 42 is thus produced. It should be noted that the second mixing step is performed in the same manner as the first mixing step.

When the first and second mixing steps finish, the mixing blades 19 and 29 are stopped, the openings 11*b* and 21*b* are opened, and the conveyance route 50 is driven. Accordingly, the particle mixture C1 and the particle mixture C2 are respectively conveyed from the first mixer 10 and the second mixer 20 along the conveyance route 50 to the opening 31*a* of the silo 31. At this time, the conveyance mechanism 36 is controlled to stop the conveyance from the opening 31*b* of the silo 31 toward the downstream side, and the particles C1 and C2 are introduced while this state is maintained. In this embodiment, at this time, the particle mixture C1 and the particle mixture C2 are introduced into the silo 31 alternately and repeatedly. In other words, all the particles C1 inside the container 11 are transferred to the silo 31, all the particles C2 inside the container 21 are then transferred to the silo 31, all the particles C1 inside the container 11, which are additionally obtained through mixing, are then transferred to the silo 31, all the particles C2 inside the container 21, which are additionally obtained through mixing, are then transferred to the silo 31, and these conveyance operations are repeated. That is, the particles C1 and the particles C2 are alternately conveyed. It should be noted that the particles C1 or the particles C2 may be conveyed first.

The blender 30 receives the particle mixture C1 conveyed from the first mixer 10 and the particle mixture C2 conveyed from the second mixer 20 in the silo 31 through the opening 31*a*, and mixes them together inside the silo 31 (blending step). In this embodiment, at this time, the particles C1 and the particles C2 are alternately loaded thereinto and are thus more uniformly mixed together inside the silo 31. As shown in FIG. 1, the layer of the particles C1 and the layer of the particles C2 are alternately stacked inside the container body 32.

Subsequently, the conveyance mechanism 36 is controlled to open the opening 31*b* of the silo 31, and the particle mixture C obtained by mixing the particle mixture C1 and the particle mixture C2 inside the blend chamber 33 is gradually transferred to the conveyance route 35*c* through the opening 31*b*. At this time, the switching mechanism 37 is controlled to couple the conveyance route 35*c* and the conveyance route 35*b* and then drive these conveyance routes 35*c* and 35*b*. Accordingly, the particle mixture C moves along the conveyance routes 35*c* and 35*b*, and returns into the silo 31. As a result, the particle mixture C passes through the silo 31 again, and the particles C1 and the particles C2 are thus more uniformly mixed together.

After the particles C1 and C2 are circulated in the silo 31 and the conveyance routes 35*b* and 35*c* a predetermined number N of circulation time, the switching mechanism 37 is controlled to couple the conveyance route 35*c* and the conveyance route 35*a* and then drive these conveyance routes 35*c* and 35*a*. Accordingly, the particle mixture C moves along the conveyance routes 35*c* and 35*a*, and is transferred toward the farther downstream side. On the downstream side, the particle mixture C is packaged by a predetermined amount in order to ship the particle mixture C as a final product, for example.

With the above-described method, the particles A1, the additive B1, the particles A2, and the additive B2 are not mixed together at once, but are mixed in a stepwise manner using the mixers 10 and 20 and the blender 30. This makes it easy to produce a large amount of particle mixture C in which two or more types of particles A1 and A2 are mixed with the additives B1 and B2.

3. Applications

The above-described production line system 100 and production method can be used to produce a particle mixture constituted by various particles including two or more types of particles. For example, the following applications are conceivable.

3-1

A certain type of resin pellets are prepared as the particles A1, and resin pellets that have an average particle diameter different from that of the particles A1 but are made of the same material as that of the particles A1 are prepared as the particles 42. Then, after additives B1 and B2 that are of the same type or different types are respectively mixed with the particles A1 and A2 in the first mixer 10 and the second mixer 20, the thus-obtained particle mixtures C1 and C2 are blended at an appropriate blending ratio using the blender 30.

With the above-described method, when the particles A1 have an average particle diameter of 300 μm, the particles A2 have an average particle diameter of 500 μm, and these particles are blended at a ratio of 1:1, the obtained resin pellets have an average particle diameter of 400 μm. That is, blending resin pellets having different average particle diameters at an appropriate blending ratio makes it possible to adjust the average particle diameter of the resin pellets included in the finally produced particle mixture C. Therefore, resin pellets with various particle diameters can be easily produced, and products are easily managed.

3-2

A certain type of resin pellets are prepared as the particles A1, and an additive B1 is mixed with the particles A1 at a predetermined blending ratio using the first mixer 10. The particle mixture C1 is thus obtained. Resin pellets of the same type as the particles A1 (having the same average particle diameter and made of the same material) are prepared as the particles A2, and an additive B2 of the same type as the additive B1 is mixed with the particles A2 at a predetermined blending ratio different from that in the case of the particles A1 using the second mixer 20. Then, these particle mixtures C1 and C2 are blended at an appropriate blending ratio using the blender 30.

With the above-described method, blending resin pellets of the same type to which an additive of the same type has been added at different blending ratios makes it possible to adjust the blending ratio of the additive in the finally produced particle mixture C. It should be noted that a configuration may be adopted in which the mixing of the additive in the second mixer 20 is omitted and the additive B1 included in the particle mixture C1 is added, in the blender 30, to the particles A2 with which no additive has been mixed. In this case, the blending ratio of the additive can be easily adjusted by producing the particle mixture C1 including the additive at a higher blending ratio using the first mixer 10 and loading this particle mixture C1 and additional resin pellets (particles A2) into the blender 30. Therefore, resin pellets with various additive blending ratios can be easily produced, and products are easily managed.

4. Modified Examples

Although an embodiment of the present invention has been described above, the present invention is not limited to the above embodiment, and various modifications can be carried out without departing from the gist of the invention. Moreover, the key points of the following modified examples can be combined as appropriate.

4-1

The structures of the first mixer 10 and the second mixer 20 are not limited to those described above, and ribbon mixers can be used as these mixers, for example. The same applies to the structure of the blender 30, and various types of gravity blenders can be used as the blender 30.

4-2

Although the first mixer 10 and the second mixer 20 are prepared in the above-described embodiment, one of these mixers can be omitted. For example, the particle mixture C1 mixed using the first mixer 10 and the particles A2 mixed with no additives can be mixed together using the blender 30. Meanwhile, a configuration may be adopted in which three or more mixers are arranged upstream of the blender 30 and three or more types of particle mixtures are mixed together using the blender 30.

4-3

Although the opening 31*b* is provided with the conveyance mechanism 36 in order to control the amount of particle mixture C conveyed from the inside of the silo 31 toward the downstream side in the above-described embodiment, an opening/closing mechanism such as an electronically controlled valve may be provided instead of the conveyance mechanism 36, for example.

4-4

Although the holes 34*b* are spaced out substantially evenly in the entire side wall of the blend pipe 34 inside the silo 31 in the above-described embodiment, the positions at which the holes 34*b* are arranged can be shifted in the up-down direction in each blend pipe 34. With this configuration, the blend pipes 34 vary in the positions in the up-down direction of the holes 34*b* through which the particle mixtures C1 and C2 pass. Therefore, the particle mixtures C1 and C2 located at different positions in the up-down direction inside the silo 31 will join together inside the blend chamber 33, thus making it possible to further improve the mixing ability of the gravity blender 30.

In the above-described embodiment, the whole amount of particle mixture C1 inside the container 11 is introduced into the silo 31 at once, and the whole amount of particle mixture C2 inside the container 21 is also introduced into the silo 31 at once. However, the whole amounts of particle mixtures C1 and C2 inside the containers 11 and 21 can be introduced into the silo 31 over multiple instances. For example, a configuration may be adopted in which a predetermined amount of particles C1 inside the container 11 are transferred to the silo 31, a predetermined amount of particles C2 inside the container 21 are then transferred to the silo 31, a predetermined amount of particles C1 inside the container 11 are then transferred to the silo 31 again, a predetermined amount of particles C2 inside the container 21 are then transferred to the silo 31 again, and these conveyance operations are repeated.

LIST OF REFERENCE NUMERALS

10 First mixer
11 Container (first container)
20 Second mixer
21 Container (second container)
30 Gravity blender
31 Silo (blender container)
31*a* Opening (inlet)
31*b* Opening (outlet)
A1 Particles (first particles)
A2 Particles (second particles)
B1 Additive (first additive)
B2 Second additive
C1, C2, C Particle mixture

The invention claimed is:

1. A production method for producing a particle mixture in which two or more types of particles are mixed, the production method comprising:

adding a first additive to first particles and mixing the first additive with the first particles using a first mixer;

adding a second additive to the second particles and mixing the second additive with the second particles using a second mixer, and introducing the two or more types of particles including the first particles mixed with the first additive and the second particles mixed with the second additive into a blender container of a gravity blender, and mixing the two or more types of particles inside the blender container, wherein the first particles and the second particles are made of the same material and have different average particle diameters, wherein the gravity blender comprises a conveyance route that is connected to a downstream portion of the blender container and extending to an upper opening of the blender container, wherein the step of introducing and mixing the two or more types of particles includes making the two or more types of particles circulate in the blender container and the conveyance route N times, and wherein the number N of circulation times of the two or more types of particles satisfies $1.5 \leq N < 2.5$, wherein N is calculated by dividing a value obtained by multiplying a flow rate of the two or more types of particles that pass through the conveyance route by a circulation period by a total amount of the two or more types of particles.

2. The production method according to claim 1, wherein the first particles and the second particles are water-absorbent resin particles.

3. The production method according to claim 1, wherein the introducing and mixing the two or more types of particles includes introducing the first particles mixed with the first additive and the second particles mixed with the second additive into the blender container alternately and repeatedly.

4. The production method according to claim 3, wherein the first particles and the second particles are water-absorbent resin particles.

5. A production apparatus configured to produce a particle mixture in which two or more types of particles are mixed, the production apparatus comprising:

a first mixer having a first container configured to accommodate first particles, the first mixer being configured to mix the first particles and a first additive together inside the first container;

a second mixer having a second container configured to accommodate second particles, the second mixer being configured to mix the second particles and a second additive together inside the second container;

a gravity blender having a blender container provided with an inlet in an upper portion, the inlet being connected to the first container and the second container, and the gravity blender being configured to receive the two or more types of particles including the first particles mixed with the first additive conveyed from the first container and the second particles mixed with the second additive conveyed from the second container in the blender container through the inlet, and mix the two or more types of particles inside the blender container; and one or more controllers, wherein the first particles and the second particles are made of the same material and have different average particle diameters, wherein the gravity blender further comprises a first conveyance route that is connected to a downstream portion of the blender container and extending to the inlet, wherein the one or more controllers are configured to drive the first conveyance route to make the two or more types of particles received by the blender container circulate N times in the blender container and the first conveyance route, wherein the number N of circulation times of the two or more types of particles satisfies $1.5 \leq N < 2.5$, N is calculated by dividing a value obtained by multiplying a flow rate of the two or more types of particles that pass through the first conveyance route by a circulation period by a total amount of the two or more types of particles.

6. The production apparatus according to claim 5, wherein a ratio of a volume of the blender container to a volume of the first container or the second container is 10 or greater.

7. The production apparatus according to claim 5, further comprises a second conveyance route that connects the inlet and the first container, wherein the second container is connected to the second conveyance route.

* * * * *